US011480346B2

(12) United States Patent
Rao et al.

(10) Patent No.: US 11,480,346 B2
(45) Date of Patent: Oct. 25, 2022

(54) AIR CONDITIONER

(71) Applicant: GD MIDEA AIR-CONDITIONING EQUIPMENT CO., LTD., Foshan (CN)

(72) Inventors: Wei Rao, Foshan (CN); Shiqiu Qi, Foshan (CN)

(73) Assignee: GD MIDEA AIR-CONDITIONING EQUIPMENT CO., LTD., Foshan (CN)

( * ) Notice: Subject to any disclaimer, the term of this patent is extended or adjusted under 35 U.S.C. 154(b) by 545 days.

(21) Appl. No.: 16/956,198

(22) PCT Filed: Feb. 15, 2017

(86) PCT No.: PCT/CN2017/073672
§ 371 (c)(1),
(2) Date: Jun. 19, 2020

(87) PCT Pub. No.: WO2018/133140
PCT Pub. Date: Jul. 26, 2018

(65) Prior Publication Data

US 2021/0222891 A1 Jul. 22, 2021

(30) Foreign Application Priority Data

Jan. 20, 2017 (CN) ..... 201710042253.9
Jan. 20, 2017 (CN) ..... 201720086564.0

(51) Int. Cl.
*F25B 1/00* (2006.01)
*F24F 1/027* (2019.01)
*F24F 13/20* (2006.01)

(52) U.S. Cl.
CPC ..... *F24F 1/027* (2013.01); *F24F 13/20* (2013.01)

(58) Field of Classification Search
CPC .... F24F 1/027; F24F 1/02; F24F 1/022; F24F 1/03; F24F 1/031; F24F 1/0341; F24F 13/20
See application file for complete search history.

(56) References Cited

U.S. PATENT DOCUMENTS 5,167,131 A 12/1992 Karkhanis
2003/0110789 A1 6/2003 Cur et al.
(Continued)

FOREIGN PATENT DOCUMENTS

CN 1163702 C 11/1997
CN 1740658 A 3/2006
(Continued)

OTHER PUBLICATIONS

Pdf file is translation of foreign reference WO 0225177 (Year: 2002).*
(Continued)

*Primary Examiner* — Henry T Crenshaw
*Assistant Examiner* — Kamran Tavakoldavani
(74) *Attorney, Agent, or Firm* — Anova Law Group PLLC

(57) ABSTRACT

An air conditioner includes a housing including an indoor cavity and an outdoor cavity spaced apart from and communicating with each other, an indoor unit assembly provided in the indoor cavity, and an outdoor unit assembly connected to the indoor unit assembly and provided in the outdoor cavity. A part of a bottom wall of the housing is recessed towards an inner cavity of the housing to form a mounting groove and penetrating opposite side walls of the housing. The mounting groove is located between the indoor cavity and the outdoor cavity.

9 Claims, 10 Drawing Sheets

(56) References Cited

U.S. PATENT DOCUMENTS

| | | | | |
|---|---|---|---|---|
| 2007/0137237 | A1 | 6/2007 | Rais | |
| 2018/0231263 | A1* | 8/2018 | Mannix | F24F 5/0035 |

FOREIGN PATENT DOCUMENTS

| | | | | |
|---|---|---|---|---|
| CN | 201246861 | Y | 5/2009 | |
| CN | 201277659 | Y | 7/2009 | |
| CN | 201575564 | U | 9/2010 | |
| CN | 101876464 | A | 11/2010 | |
| CN | 101876465 | A | 11/2010 | |
| CN | 101876466 | A | 11/2010 | |
| CN | 101876467 | A | 11/2010 | |
| CN | 101876468 | A | 11/2010 | |
| CN | 102455025 | A | 5/2012 | |
| CN | 104566666 | A | 4/2015 | |
| CN | 206531182 | U | 9/2017 | |
| JP | H09280642 | A | 10/1997 | |
| JP | 2016523749 | A | 8/2016 | |
| KR | 20050116217 | A | 12/2005 | |
| WO | 0225177 | A1 | 3/2002 | |
| WO | WO 0225177 | A1 * | 3/2002 | F24F 1/02 |
| WO | 2013040670 | A1 | 3/2013 | |

OTHER PUBLICATIONS

The China National Intelleectual Property Administration (CNIPA), The First Office Action for 20170042253.9, dated Jan. 17, 2019, 14 Pages (With Translation).

The China National Intelleectual Property Administration (CNIPA), The First Office Action for 20170042253.9, dated Oct. 11, 2019, 11 Pages (With Translation).

The China National Intelleectual Property Administration (CNIPA), The First Office Action for 202010526820.X, dated Mar. 3, 2021, 10 Pages (With Translation).

The China National Intelleectual Property Administration (CNIPA), The First Office Action for 202010526820.X, dated Aug. 31, 2021, 12 Pages (With Translation).

The China National Intelleectual Property Administration (CNIPA), The First Office Action for 202010526817.8, dated Apr. 2, 2021, 16 Pages (With Translation).

The China National Intelleectual Property Administration (CNIPA), The First Office Action for 202010526817.8, dated Sep. 1, 2021, 16 Pages (With Translation).

The China National Intelleectual Property Administration (CNIPA), The First Office Action for 202010519856.5, dated Apr. 2, 2021, 16 Pages (With Translation).

The China National Intelleectual Property Administration (CNIPA), The First Office Action for 202010519856.5, dated Sep. 1, 2021, 16 Pages (With Translation).

The China National Intelleectual Property Administration (CNIPA), The First Office Action for 202010519866.9, dated Mar. 3, 2021, 10 Pages (With Translation).

The China National Intelleectual Property Administration (CNIPA), The First Office Action for 202010519866.9, dated Aug. 31, 2021, 12 Pages (With Translation).

The China National Intelleectual Property Administration (CNIPA), The First Office Action for 202010520318.8, dated Mar. 3, 2021, 10 Pages (With Translation).

The China National Intelleectual Property Administration (CNIPA), The First Office Action for 202010520318.8, dated Aug. 31, 2021, 13 Pages (With Translation).

The China National Intelleectual Property Administration (CNIPA), The First Office Action for 202010519850.8, dated Mar. 2, 2021, 12 Pages (With Translation).

The China National Intelleectual Property Administration (CNIPA), The First Office Action for 202010519857.X, dated Feb. 26, 2021, 10 Pages (With Translation).

World Intellectuactual Property Organization (WIPO), International Search Report and Written Opinion for PCT/CN2017/073672, dated Oct. 26, 2017, 16 Pages(Translation Included).

* cited by examiner

AIR CONDITIONER

CROSS-REFERENCE TO RELATED APPLICATIONS

This application is a National Stage Entry under 35 U.S.C. § 371 of International Application No. PCT/CN2017/073672, filed Feb. 15, 2017, which claims priority to Chinese Application Nos. 201720086564.0 and 201710042253.9, both filed Jan. 20, 2017, the entire contents of all of which are incorporated herein by reference.

TECHNICAL FIELD

The present disclosure relates to the technical field of air conditioning equipment, and more particularly, to an air conditioner.

BACKGROUND

In related art, an air conditioner has a split structure. The air conditioner indoor unit is located indoors, and the air conditioner outdoor unit is located outdoors. The indoor unit and outdoor unit need to be connected by a pipeline passing through the wall. The method for mounting the air conditioner is complicated, and the mounting process is cumbersome.

SUMMARY

The present disclosure aims to solve one of the technical problems in the related arts at least to a certain extent. For this purpose, the present disclosure provides an air conditioner. The structure of the air conditioner is simple and compact. The connection between various components of the air conditioner is reliable, the process for mounting the air conditioner is simple, it is convenient for fixing the air conditioner, and the working noise is low.

An air conditioner according to an embodiment of the present disclosure includes: a housing, the housing including an indoor cavity and an outdoor cavity spaced apart from and communicating with each other, a middle part of a bottom wall of the housing being recessed towards an inner cavity of the housing to form a mounting groove outside the housing and penetrating opposite side walls of the housing, the mounting groove being located between the indoor cavity and the outdoor cavity; an indoor unit assembly provided in the indoor cavity; and an outdoor unit assembly connected to the indoor unit assembly and provided in the outdoor cavity.

According to an embodiment of the present disclosure, by forming a mounting groove with a down-facing opening on the outside of the housing, it is convenient to mount the air conditioner across the lower window frame on the wall without pre-processing the wall and the window frame, and the installation is convenient. Therefore, it not only can simplify the installation process of the air conditioner, but also ensures the stability of the installation of the air conditioner, and the movement is small. And after the installation of the air conditioner is completed, the indoor unit assembly and the outdoor unit assembly are located on two sides of the wall, respectively, and the sound insulation effect is better, improving the user experience. Furthermore, compared with the air conditioner in the related art, there is no risk of the indoor unit assembly and the outdoor unit assembly falling, and the use safety is high.

Besides, the air conditioner according to an embodiment of the present disclosure may also have the following additional technical features.

According to another embodiment of the present disclosure, the housing includes: a chassis, a longitudinal sectional shape of a middle part of the chassis being generally an "n" shape with a down-facing opening to form the mounting groove; and an outer cover covering the chassis, the indoor cavity and the outdoor cavity spaced apart being formed between the outer cover and the chassis, the outer cover and a bottom wall of the mounting groove being configured to form a mounting channel communicating with the indoor cavity and the outdoor cavity.

According to an embodiment of the present disclosure, the indoor unit assembly and the outdoor unit assembly are connected through a refrigerant pipeline and a power line, and at least a part of the refrigerant pipe and at least a part of the power line are configured to pass through the mounting channel.

According to an embodiment of the present disclosure, an outer edge of the chassis is provided with a flange, and the flange is connected to the outer cover.

According to an embodiment of the present disclosure, the chassis includes: an indoor chassis, the indoor unit assembly being mounted at the indoor chassis; an outdoor chassis, the outdoor unit assembly being mounted at the outdoor chassis; and a connection plate, two ends of the connection plate being respectively connected to the indoor chassis and the outdoor chassis, a sectional shape of the connection plate being generally an "n" shape with a down-facing opening.

According to an embodiment of the present disclosure, the chassis is integrally formed.

According to an embodiment of the present disclosure, the air conditioner is configured to be mounted at a window on a wall, the chassis is configured to straddle a lower window frame of the wall, the indoor unit assembly is configured to be located indoors and the outdoor unit assembly is configured to be located outdoors.

According to an embodiment of the present disclosure, the outer cover includes: two side plates provided at opposite sides of the chassis and connected to the chassis, each of the two side plates including an avoiding groove for avoiding the mounting groove; and a top cover covering and connected to the two side plates.

According to an embodiment of the present disclosure, each of the two side plates and the top cover are integrally formed.

According to an embodiment of the present disclosure, a longitudinal sectional shape of the housing is generally an inverted concave shape.

According to an embodiment of the present disclosure, the indoor unit assembly includes an evaporator, the outdoor unit assembly includes a condenser and a compressor, and the evaporator, the condenser, and the compressor are connected through a refrigerant pipeline.

Additional aspects and advantages of the present disclosure will be partially given in the following description, and some will become apparent from the following description, or be learned through the practice of the present disclosure.

REFERENCE NUMBERS

Figure 1:
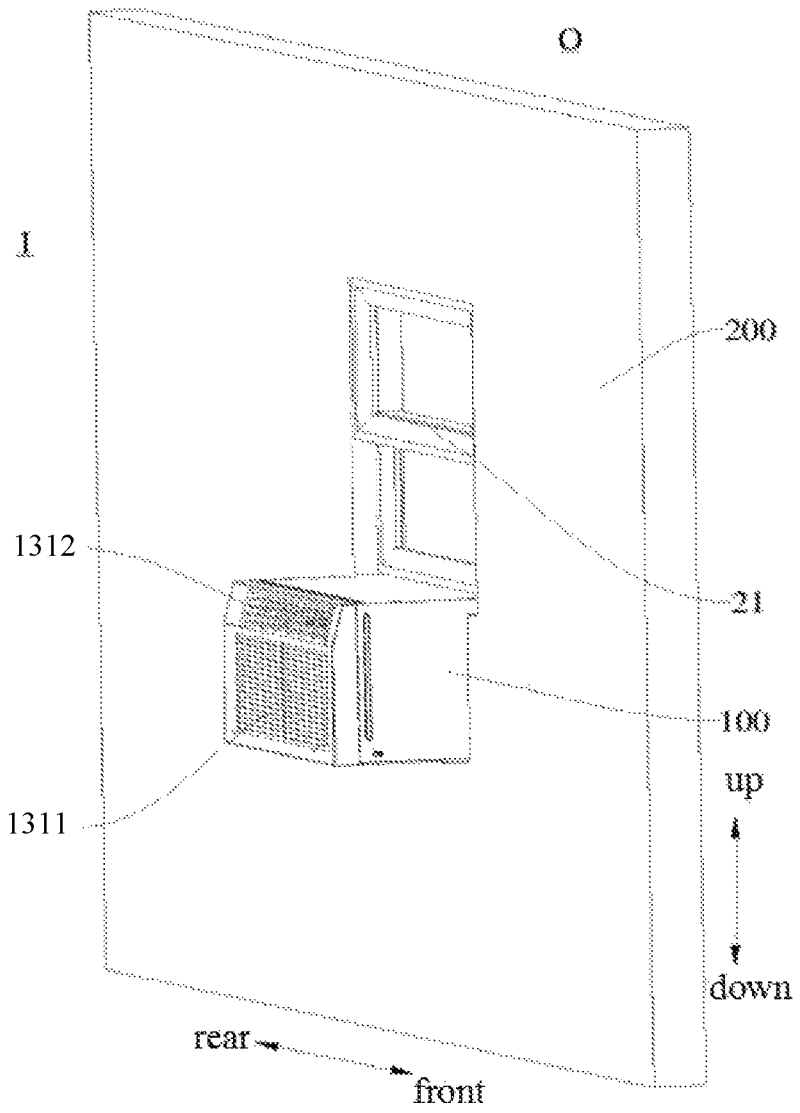
FIG. 1 is a schematic diagram of an air conditioner when mounted at a wall according to an embodiment of the present disclosure.

I: indoor; O: outdoor;
100: air conditioner;
11: chassis;
111: indoor chassis;
112: outdoor chassis;
113: connection plate; 1131: vertical plate; 1132: horizontal plate; 1133: mounting groove
114: flange;
12: outer cover;
121: side plate;
122: top cover
131: first cover plate; 1311: air inlet; 1312: air outlet; 132: second cover plate;
14: indoor unit assembly; 141: evaporator; 142: water receiving tray; 143: impeller
15: outdoor unit assembly; 151: compressor; 152: condenser; 153: motor; 154: fan; 200: wall; 21: window.

DETAILED DESCRIPTION OF THE EMBODIMENTS

The embodiments of the present disclosure are described in detail below, and examples of the embodiments are shown in the drawings. The embodiments described below with reference to the drawings are exemplary, and are intended to explain the present disclosure, and should not be construed as limiting the present disclosure.

An air conditioner 100 according to an embodiment of the present disclosure will be described in detail below with reference to FIGS. 1 to 12.

The air conditioner 100 according to an embodiment of the present disclosure includes a housing, an indoor unit assembly 14 and an outdoor unit assembly 15. Specifically, the housing includes an indoor cavity and an outdoor cavity spaced apart from and communicating with each other, a middle part of a bottom wall of the housing is recessed towards an inner cavity of the housing to form a mounting groove 1133 outside the housing and penetrating opposite side walls of the housing, the mounting groove 1133 is located between the indoor cavity and the outdoor cavity. The indoor unit assembly 14 is provided in the indoor cavity; and the outdoor unit assembly 15 is connected to the indoor unit assembly 14 and provided in the outdoor cavity.

In other words, the air conditioner 100 mainly includes the housing, the indoor unit assembly 14 and the outdoor unit assembly 15. The housing may be generally cuboid. The housing includes an indoor cavity and an outdoor cavity spaced apart along its length (the left-right direction shown in FIGS. 2 and 3). The indoor cavity and the outdoor cavity communicate with each other to facilitate the connection of lines and pipelines. The middle part of the bottom wall of the housing is recessed towards the inner cavity of the housing (up direction shown in FIG. 3) to form the mounting groove 1133 outside the housing. The mounting groove 1133 is located between the indoor cavity and the outdoor cavity. The mounting groove 1133 penetrates the opposite side walls of the housing (front and rear side walls shown in FIG. 3) along a width direction of the housing (the front-rear direction shown in FIG. 3). That is, the indoor cavity, the mounting groove 1133, and the outdoor cavity are sequentially arranged along the length direction of the housing.

Figure 10:
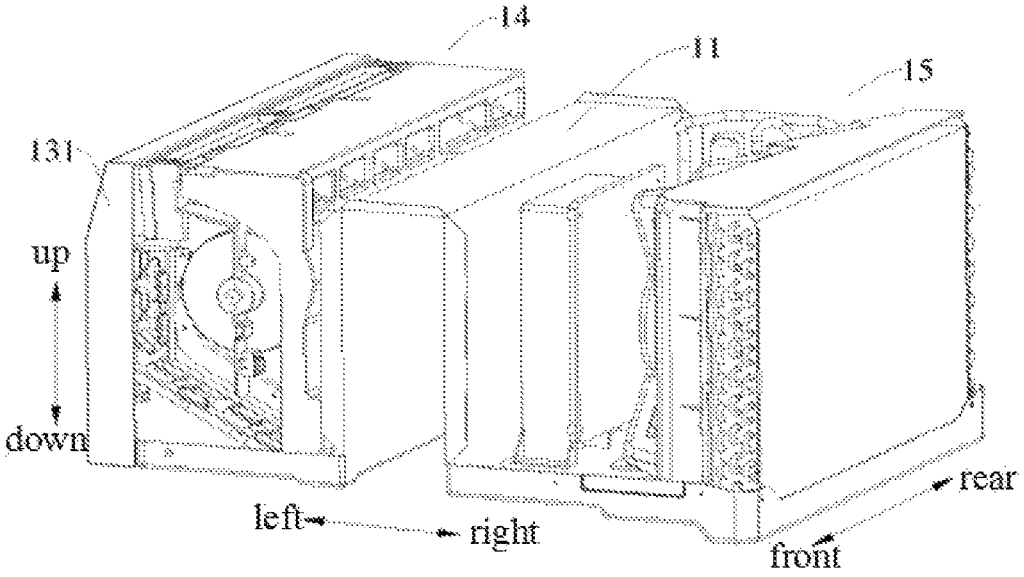
FIG. 10 is a partial assembly diagram of the air conditioner shown in FIG. 1.

Further, as shown in FIG. 10, the indoor unit assembly 14 is detachably provided in the indoor cavity of the housing, and the outdoor unit assembly 15 is detachably provided in the outdoor cavity of the housing and is connected to the indoor unit assembly 14 through a refrigerant pipeline and a power line.

Figure 2:
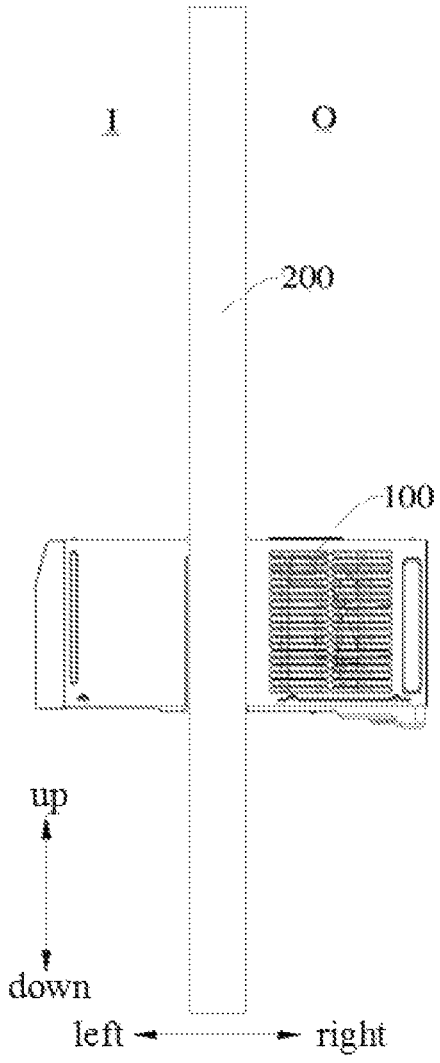
FIG. 2 is a side view of the structure shown in FIG. 1.
Figure 3:
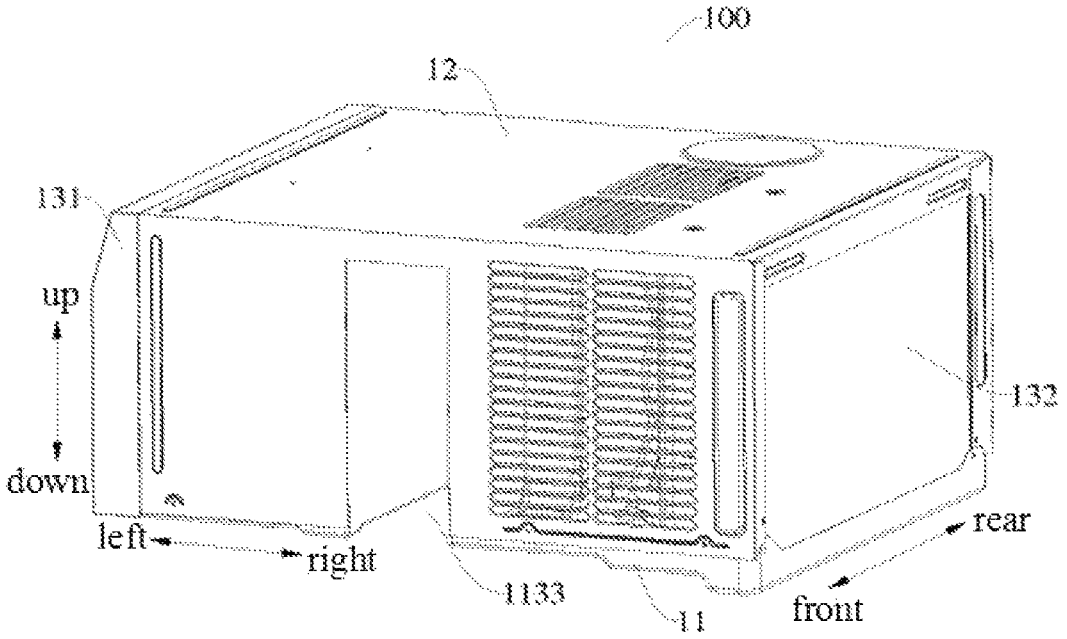
FIG. 3 is a schematic structural diagram of the air conditioner shown in FIG. 1.

When the air conditioner 100 is being mounted, the air conditioner 100 may straddle on the window frame of the window 21 on the wall 200. Specifically, as shown in FIGS. 1 and 2, the wall 200 is provided with the vertical sliding window 21, and the air conditioner 100 is mounted at the lower window frame of the window 21, such that a part of the housing is located indoors on one side of the wall 200, and another part of the housing is located outdoors on the other side of the wall 200, while the window frame and the wall 200 are located in the mounting groove 1133 of the housing. That is, the indoor unit 14 of the air conditioner 100 is located indoors on one side of the wall 200, and the outdoor unit 15 of the air conditioner 100 is located outdoors on the other side of the wall 200, thereby ensuring the normal operation of the air conditioner 100.

Specifically, after the installation of the air conditioner 100 is completed, the middle part of the housing of the air conditioner 100 is located on the lower window frame, and the vertical sliding window 21 is located on the top of the housing of the air conditioner 100. Since only a portion of the housing of the air conditioner 100 with a small thickness is located on the lower window frame, it does not affect the sliding of the vertical sliding windows 21. When the window 21 is closed, the tightness of the closed window 21 can still be ensured.

It should be noted here the size of the mounting groove 1133 in the width direction of the housing (the front-rear direction shown in FIGS. 1 and 3) is slightly smaller than the width size of the window 21, and the size of the mounting groove 1133 in the length direction of the housing (the left-right direction shown in FIGS. 1 and 3) is slightly larger than a thickness size of the wall 200, thereby ensuring that when the air conditioner 100 is mounted at the lower window frame of the wall 200, no back-and-forth, left-right movement will occur, ensuring the installation stability of the air conditioner 100, thereby improving the use safety. After the installation of the air conditioner 100 is completed, the indoor unit assembly 14 and the outdoor unit assembly 15 are located on two sides of the wall 200, respectively, and the sound insulation effect is good.

Thus, according to an embodiment of the present disclosure, by forming a mounting groove 1133 with a down-facing opening on the outside of the housing, it is convenient to mount the air conditioner 100 straddling the lower window frame on the wall 200 without pre-processing the wall 200 and the window frame, and the installation is convenient. Therefore, it not only can simplify the installation process of the air conditioner 100, but also ensures the stability of the installation of the air conditioner 100, and the movement is small. And after the installation of the air conditioner 100 is completed, the indoor unit assembly 14 and the outdoor unit assembly 15 are located on two sides of the wall 200, respectively, and the sound insulation effect is better, improving the user experience. Furthermore, compared with the air conditioner in the related art, there is no risk of the indoor unit assembly 14 and the outdoor unit assembly 15 falling, and the use safety is high.

The housing includes a chassis 11 and an outer cover 12. A longitudinal sectional shape of a middle part of the chassis 11 is generally an "n" shape with a down-facing opening to form the mounting groove 1133. The outer cover 12 covers the chassis 11, the indoor cavity and the outdoor cavity spaced apart are formed between the outer cover 12 and the chassis 11, the outer cover 12 and a bottom wall of the mounting groove 1133 are configured to form a mounting channel (not shown) communicating with the indoor cavity and the outdoor cavity, respectively.

That is, the housing of the air conditioner 100 mainly includes the chassis 11 and the outer cover 12. The chassis 11 is configured to mount and carry the weight of the internal components of the air conditioner 100. The outer cover 12 is provided at the chassis 11. The indoor cavity, the mounting channel and the outdoor cavity are formed along a length direction of the housing (left-right direction shown in FIGS. 3 and 4) between the outer cover 12 and the chassis 11. The indoor cavity is located on one side of the inner cavity of the housing (left side shown in FIGS. 3 and 4), and the outdoor cavity is located on the other side of the inner cavity of the housing (right side shown in FIGS. 3 and 4). The mounting channel is located in the middle part of the inner cavity of the housing, and two ends of the mounting channel (left and right ends shown in FIG. 4) communicate with the indoor cavity and the indoor cavity respectively.

Further, the middle part of the bottom wall of the housing (i.e., the bottom wall of the chassis 11) is recessed towards the inner cavity of the housing so that the outer surface of the chassis 11 includes a mounting groove 1133 on the outside of the housing. That is, the mounting groove 1133 is in communication with the outside of the housing, the mounting groove 1133 is located below the mounting channel, and the mounting groove 1133 is not in communication with the mounting channel. When the air conditioner 100 is mounted at a window frame on the wall 200, the mounting groove 1133 on the chassis 11 straddles the lower window frame on the wall 200 to ensure stable installation of the air conditioner 100 and high safety.

It should be understood that the sectional shape of the middle part of the chassis 11 along the direction perpendicular to the width of the housing is an "n" shape with a down-facing opening or an inverted U shape. Thus, a mounting groove 1133 that communicates with the outside is formed in the middle part of the chassis 11. That is, the mounting groove 1133 penetrates the front and rear side walls of the housing to provide a housing space for the wall 200 for the installation of the air conditioner 100, thereby ensuring the stability of the chassis 11 mounted at the lower window frame on the wall 200.

Thus, since the mounting groove 1133 with the down-facing opening is formed at the bottom of the housing, the air conditioner 100 can be mounted straddling the wall 200, which is easy to install, and beautiful and novel in appearance. Meanwhile, after the installation of the air conditioner 100 is completed, since the indoor unit 14 and the outdoor unit 15 are located on two sides of the wall 200, the sound insulation effect is better.

The indoor unit assembly 14 and the outdoor unit assembly 15 are connected through a refrigerant pipeline and a power line, and at least a part of the refrigerant pipe and the power line are configured to pass through the mounting channel.

Specifically, the indoor unit assembly 14 and the outdoor unit assembly 15 of the air conditioner 100 are located on two sides of the inner cavity of the housing. Since the indoor cavity, the outdoor cavity and the mounting channel of the housing communicate with each other, the refrigerant pipeline and the power line of the indoor unit assembly 14 can be connected to the outdoor unit assembly 15 through the mounting channel. The refrigerant pipeline and the power line of the outdoor unit assembly 15 can also be connected to the indoor unit assembly 14 through the mounting channel to ensure the normal connection between the indoor unit assembly 14 and the outdoor unit assembly 15. Besides, due to the long size of the mounting channel along the width of the housing, the refrigerant pipeline and the power line are not restricted by space. The positions of the refrigerant pipeline and the power line can be adjusted as needed, which is convenient for adjustment and beneficial to improve the assembly efficiency of the air conditioner 100, thereby improve the production efficiency of the air conditioner 100.

As such, the mounting channel between the indoor cavity and the outdoor cavity is formed in the housing to facilitate the connection between the indoor unit assembly 14 and the outdoor unit assembly 15, ensuring the normal operation of the air conditioner 100. After the installation of the air conditioner 100 is completed, since the indoor unit assembly 14 and the outdoor unit assembly 15 are located on two sides of the wall 200, respectively, the refrigerant pipeline and the power line are located in the housing, which is convenient for adjustment. Compared with the air conditioner in the related art where the line is provided outside the housing, the structure is more compact, the installation is more convenient, and the sound insulation effect is better.

Alternatively, the size of the mounting channel in the width direction of the housing (front-rear direction shown in FIG. 4) is equal to the size of the indoor cavity and the outdoor cavity in the width direction of the housing, thereby providing a storage space for the refrigerant pipeline and power lines between the indoor unit assembly 14 and the outdoor unit assembly 15. The refrigerant pipeline and the power line are not limited by space, and the positions of the refrigerant pipeline and the power line can be adjusted as needed, which is convenient for adjustment, and beneficial to improve the assembly efficiency of the air conditioner 100, thereby improve the production efficiency of the air conditioner 100.

Advantageously, a flange 114 is provided at the outer edge of the chassis 11, and the flange 114 is connected to the outer cover 12. For example, a part of the chassis 11 forms a horizontal plate arranged in a horizontal plane, and the outer edge of the horizontal plate is bent upward to form a flange 114. The outer cover 12 is provided at the chassis 11 and is detachably connected to the flange 114 on the chassis 11 to facilitate the connection between the chassis 11 and the outer cover 12 and simplify the connection process of the two.

In some specific embodiments of the present disclosure, the chassis 11 includes an indoor chassis 111, an outdoor chassis 112 and a connection plate 113. The indoor unit assembly 14 is mounted at the indoor chassis 111, and the outdoor unit assembly 15 is mounted at the outdoor chassis 112. The two ends of the connection plate 113 are respectively connected to the indoor chassis 111 and the outdoor chassis 112 to be suitable for straddling on the wall 200, and the sectional shape of the connection plate 113 is generally an "n" shape with the down-facing opening.

In other words, the chassis 11 mainly includes the indoor chassis 111, the outdoor chassis 112 and the connection plate 113. The indoor chassis 111 is suitable for installation in the indoor on one side of the wall 200, and the outdoor chassis 112 is suitable for installation in the outdoor on the other side of the wall 200. The connection plate 113 is located between the indoor chassis 111 and the outdoor chassis 112 and is connected to the indoor chassis 111 and the outdoor chassis 112 at both ends, and is used to straddle the lower window frame on the wall 200.

Specifically, the indoor chassis 111 and the outdoor chassis 112 of the chassis 11 respectively form horizontal plates arranged in a horizontal plane. The connection plate 113 mainly includes two vertical plates 1131 and one horizontal plate 1132. The two vertical plates 1131 are spaced apart along the length of the housing (left-right direction shown in FIGS. 5 and 6). Each vertical plate 1131 extends in the height direction of the housing (up-down direction shown in FIGS. 5 and 6). The upper ends of the two vertical plates 1131 are respectively connected to the two ends (left and right ends shown in FIGS. 5 and 6) of the horizontal plate 1132. The lower ends of the two vertical plates 1131 are respectively connected to the inner ends of the indoor chassis 111 and the outdoor chassis 112 (the right end of the indoor chassis 111 and the left end of the outdoor chassis 112 shown in FIGS. 5 and 6). The sectional shape of the connection plate 113 is generally an "n" shape with the down-facing opening to form the mounting groove 1133 that communicates with the outside. In addition, a flange 114 is provided at the front and rear sides of each vertical plate 1131, and a flange 114 is provided at the front and rear sides of the horizontal plate 1132, respectively, so as to facilitate connection with the outer cover 12.

Figure 7:
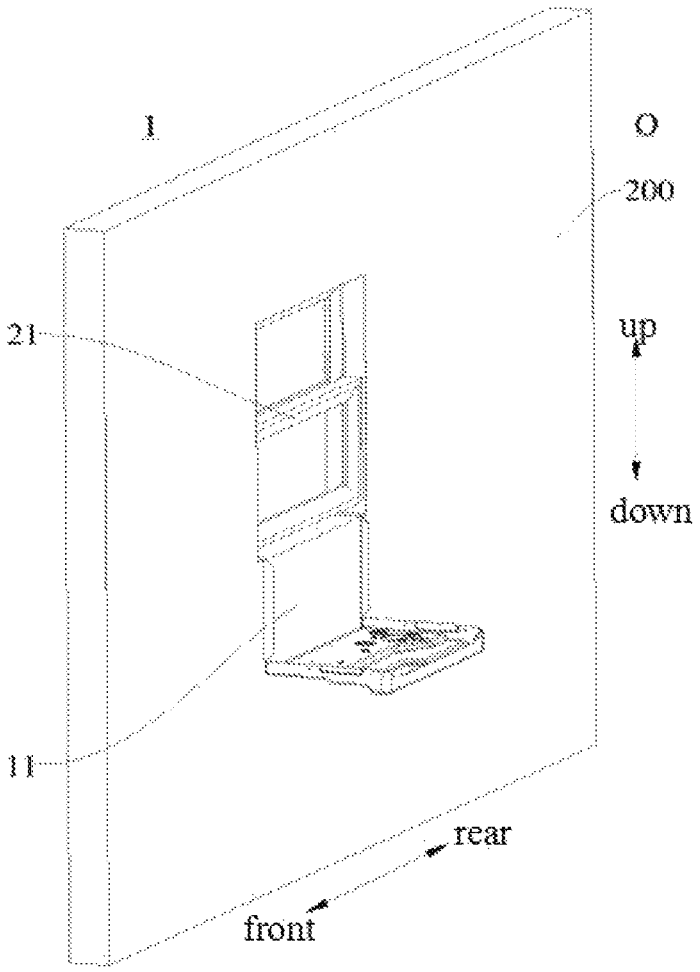
FIG. 7 is a schematic diagram of the chassis shown in FIG. 5 when mounted at a wall.
Figure 8:
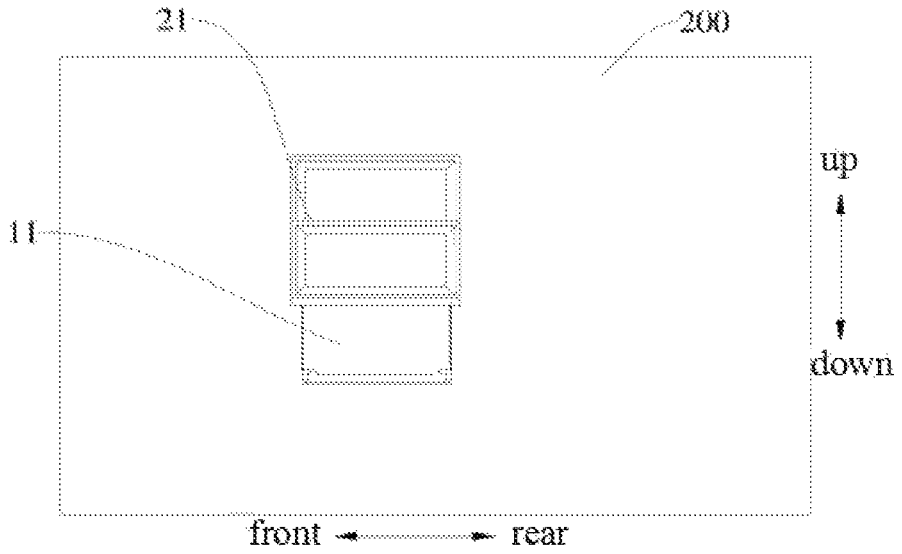
FIG. 8 is a schematic diagram of the structure shown in FIG. 7 viewed from one direction.
Figure 9:
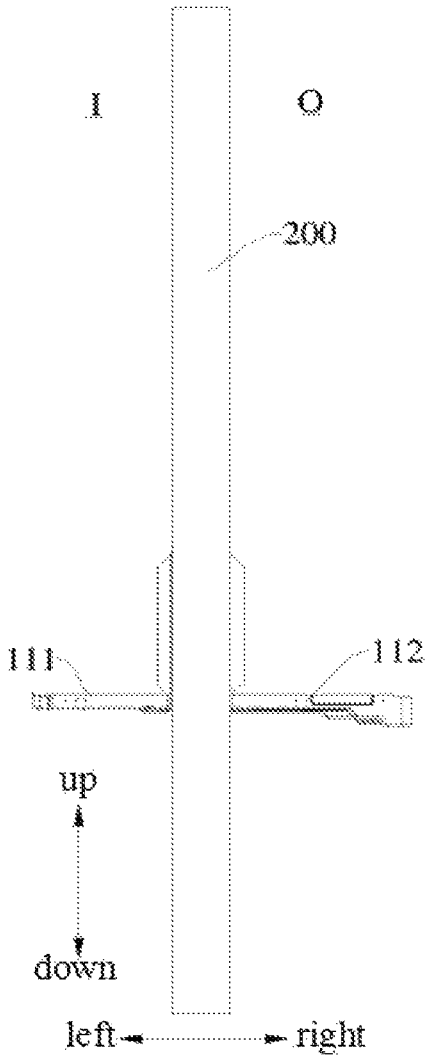
FIG. 9 is a schematic diagram of the structure shown in FIG. 7 viewed from another direction.

As shown in FIG. 7 to FIG. 9, when the air conditioner 100 is mounted, the chassis 11 of the air conditioner 100 straddles the lower window frame of the wall 200, that is, the horizontal plate 1132 of the connection plate 113 of the chassis 11 is connected to the lower window frame. A vertical plate 1131 of the connection plate 113 of the chassis 11 is located indoor on the side of the wall 200, the other vertical plate 1131 of the connection plate 113 of the chassis 11 is located outdoor on the other side of the wall 200. The indoor chassis 111 of the chassis 11 is configured to install and carry the indoor unit assembly 14, the outdoor chassis 112 of the chassis 11 is configured to install and carry the outdoor unit assembly 15.

Therefore, the chassis 11 has a simple structure, a novel appearance. It is easy for processing and manufacturing the chassis 11, and the installation of the chassis 11 is convenient. The indoor unit 14 and the outdoor unit 15 can be separately arranged in two areas to avoid mutual influence, and the air conditioner 100 can be conveniently mounted at the lower window frame of the wall 200, and the operation is simple, thereby reducing the installation cost.

According to an embodiment of the present disclosure, the chassis 11 is integrally formed. Thus, the integrally-formed structure not only can ensure the structure and performance stability of the chassis 11, but also facilitates molding and simple manufacturing. Moreover, redundant assembly parts and connection processes are omitted, which greatly improves the assembly efficiency of the air conditioner 100 and ensures the connection reliability of the chassis 11 and the outer cover 12 and other components. Furthermore, the integrally-formed structure has higher overall strength, stability, and longer life, and it is more convenient for assembly.

Advantageously, when the air conditioner 100 is mounted at a window on the wall 200, the chassis 11 straddles on the lower window frame of the wall 200 so that the indoor unit assembly 14 is located indoors and the outdoor unit assembly 15 is located outdoors.

Specifically, after the installation of the air conditioner 100 is completed, a part of the chassis 11 is located indoors, ensuring that the indoor unit assembly 14 is mounted at the chassis 11, and the other part of the chassis 11 is located outdoors, ensuring that the outdoor unit assembly 15 is mounted at the chassis 11, and the indoor unit assembly 14 and the outdoor unit assembly 15 will not interfere, thereby ensuring the normal operation of the air conditioner 100.

Figure 4:
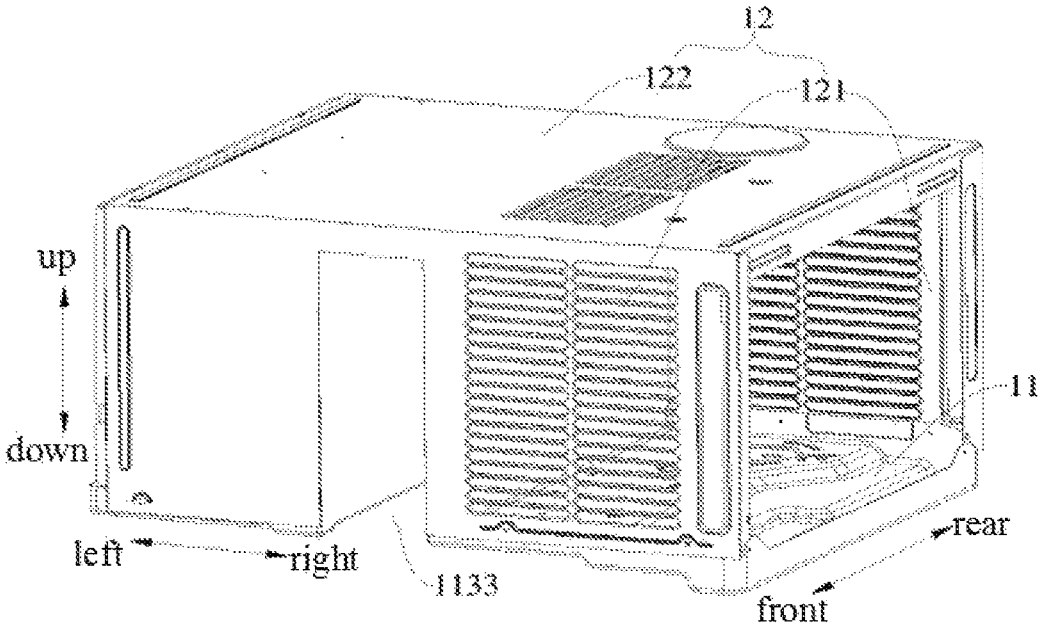
FIG. 4 is an assembly diagram of a chassis and an outer cover of the air conditioner shown in FIG. 3.
Figure 5:
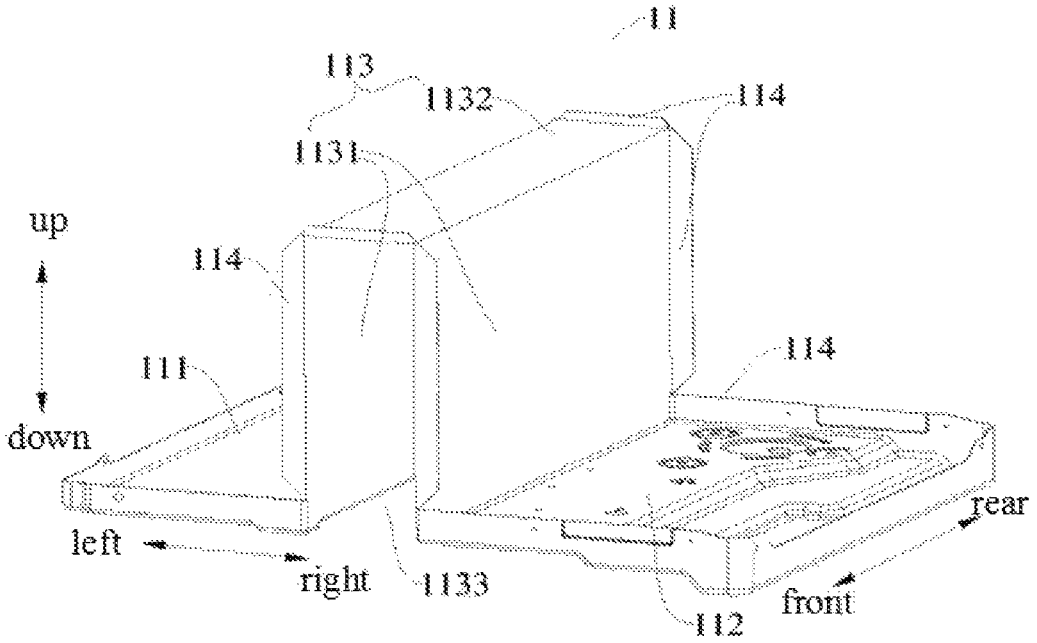
FIG. 5 is a schematic structural diagram of the chassis of the air conditioner shown in FIG. 3.
Figure 6:
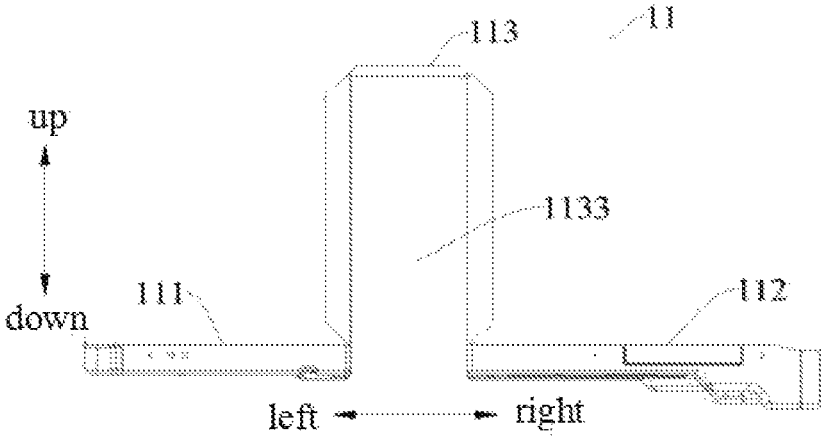
FIG. 6 is a front view of the chassis shown in FIG. 5.

As shown in FIG. 4, the outer cover 12 includes two side plates 121 and a top cover 122. The two side plates 121 are provided at opposite sides of the chassis 11 and connected to the chassis 11, and each of the two side plates 121 includes an avoiding groove for avoiding the mounting groove 1133. The top cover 122 is configured to cover and is connected to the two side plates 121.

In other words, the outer cover 12 of the housing mainly includes two side plates 121 and the top cover 122. The two side plates 121 are spaced apart along the width direction of the housing (front-rear direction shown in FIG. 4), and the two side plates 121 are located on the front and rear sides of the chassis 11, respectively. Each side plate 121 forms a plate member extending in a vertical direction (up-down direction shown in FIG. 4). The top cover 122 is covered on the chassis 11 and the front side of the top cover 122 is connected to the upper end of the side plate 121 located on the front side, and the rear side of the top cover 122 is connected to the upper end of the side plate 121 located on the rear side.

The middle part of each side plate 121 is provided with an avoiding groove for avoiding the mounting groove 1133 of the chassis 11, and the length of the avoiding groove in the height direction of the housing is smaller than the height of the housing. The parts of the two side plates 121 each located on one side of the corresponding avoiding groove and the indoor chassis 111 form the indoor cavity. The parts of the two side plates 121 each located on the other side of the corresponding avoiding groove and the outdoor chassis 112 form the outdoor cavity. That is, the indoor cavity and the outdoor cavity are located on two sides of each avoiding groove, respectively.

A grille is provided at the portion of the outer cover 12 above the outdoor chassis 112 (for example, the top cover 122 and the two side plates 121 above the outdoor chassis 112) to facilitate heat dissipation of the outdoor unit assembly 15. The indoor end (left end shown in FIG. 3) of the outer cover 12 is provided with a first cover plate 131, and the first cover plate 131 is provided with an air inlet 1311 and an air outlet 1312. The hot air indoors enters the indoor cavity, exchanges heat with the indoor unit assembly 14 to cool down, and then is discharged into the room through the air outlet 1312. The first cover 131 is provided with an air inlet 1311 and an air outlet 1312, so that the air indoors can circulate in the indoor cavity and the outside. A second cover plate 132 is provided at the outdoor end (right end shown in FIG. 3) of the outer cover 12 so as to close the opening of the outdoor cavity.

According to an embodiment of the present disclosure, each of the side plates 121 and the top cover 122 are integrally formed. Thus, the integrally-formed structure not only can ensure the structure and performance stability of the outer cover 12, but also facilitates molding and simple manufacturing. Moreover, redundant assembly parts and connection processes are omitted, which greatly improves the assembly efficiency of the air conditioner 100 and ensures the connection reliability of the outer cover 12 and other components. Furthermore, the integrally-formed structure has higher overall strength, stability, and longer life, and it is more convenient for assembly.

Alternatively, a longitudinal sectional shape of the housing is generally an inverted concave shape.

That is, the sectional shape of the housing at any position perpendicular to its width direction forms a concave shape. That is, the sizes in the width direction of the top cover 122 of the housing are always equal, and the sizes of the horizontal plate 1132 of the connection plate 113 of the chassis 11 in the width direction of the housing are always equal and are approximately equal to the sizes of the top cover 122 in the width direction of the housing, to ensure that the sizes of the mounting channel, the indoor cavity, and the outdoor cavity in the width direction of the housing are always equal.

Since the size of the mounting channel in the height direction of the housing is small, and the size in the width direction of the housing is large, when the air conditioner 100 is mounted at the window frame of the wall 200, it occupies a small space and does not affect the activity of the vertical sliding window. Moreover, the refrigerant pipeline and the power line are in the mounting channel and are not restricted by space. The position of the refrigerant pipeline and the power line can be adjusted according to needs, which is convenient to adjust and is advantageous to improve the assembly efficiency of the air conditioner 100, thereby improving the production efficiency of the air conditioner 100.

Besides, the indoor unit assembly 14 includes an evaporator 141, the outdoor unit assembly 15 includes a condenser 152 and a compressor 151, and the evaporator 141, the condenser 152, and the compressor 151 are connected through a refrigerant pipeline.

Figure 11:
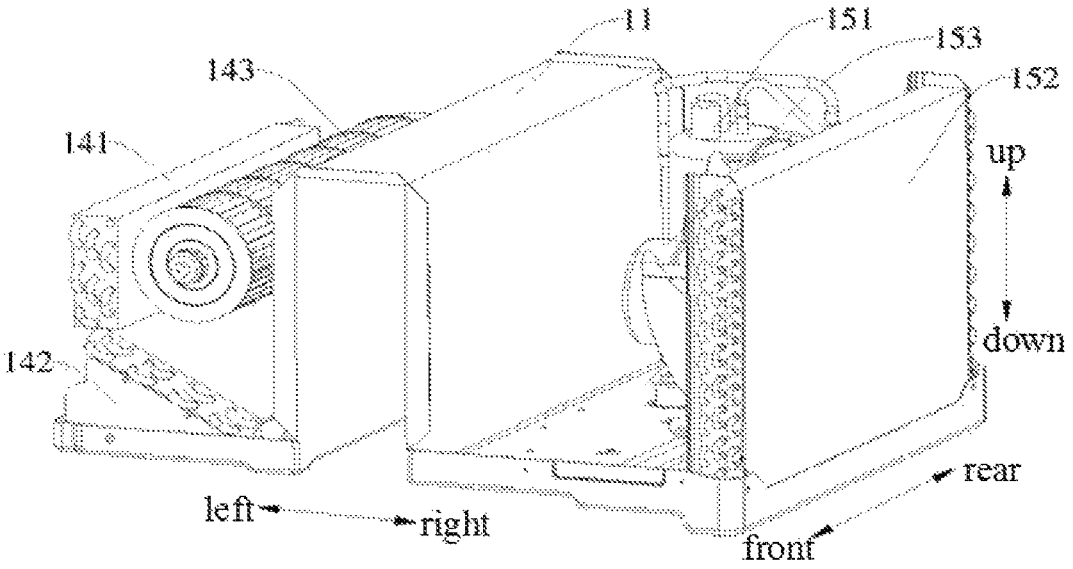
FIG. 11 is an assembly diagram of the chassis of the air conditioner shown in FIG. 1 and a compressor, a condenser, an evaporator, etc.
Figure 12:
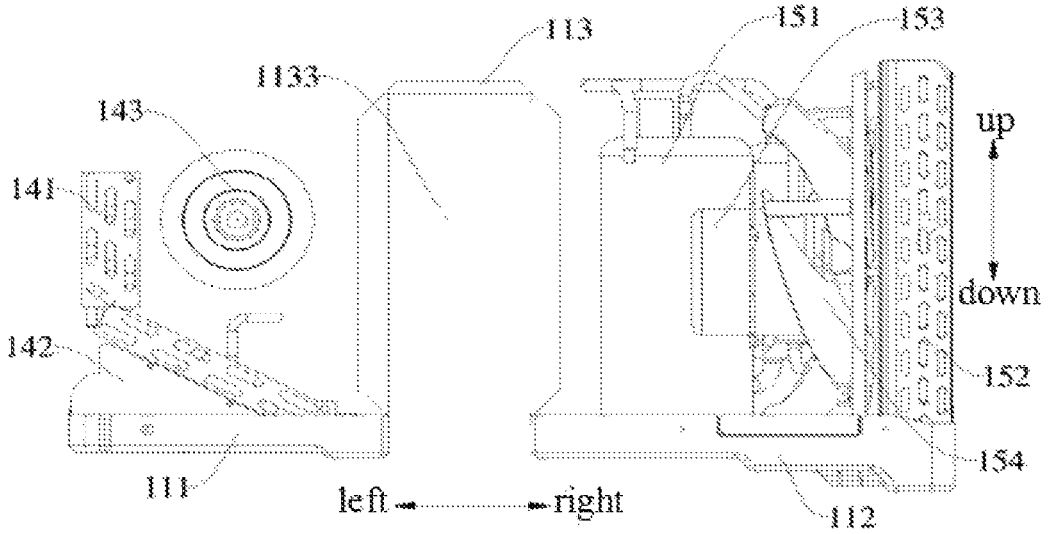
FIG. 12 is a side view of the structure shown in FIG. 11.

Specifically, as shown in FIG. 10 to FIG. 12, the outdoor unit assembly 15 mainly includes a condenser 152, a compressor 151, a motor 153, and a fan 154. The condenser 152, the compressor 151, the motor 153, and the fan 154 are all installed on the outdoor chassis 112. The compressor 151 is adjacent to the connection plate 113 of the chassis 11. The condenser 152 is adjacent to the outer end of the outdoor chassis 112. That is, the compressor 151 and the condenser 152 are spaced apart from each other and the compressor 151 and the condenser 152 are connected through a refrigerant line. The fan 154 is provided between the compressor 151 and the condenser 152 and connected to the motor 153 to discharge the heat around the compressor 151 and the condenser 152 from the grill. The fan 154 can speed up the air flow and improve the heat dissipation efficiency.

Further, the indoor unit assembly 14 mainly includes an evaporator 141, an impeller 143, and a water receiving tray 142. The water receiving tray 142 is provided at the indoor chassis 111. The evaporator 141 is located above the water receiving tray 142 and adjacent to the first cover plate 131. The impeller 143 is provided between the evaporator 141 and the connection plate 113. Therefore, the cold generated by the evaporator 141 is discharged to the room through the air outlet 1312 on the first cover plate 131, and the purpose of adjusting the room temperature is achieved. The impeller 143 can accelerate the discharge of cooling capacity.

The installation process of the air conditioner 100 according to an embodiment of the present disclosure will be described in detail below with reference to the drawings.

Referring to FIG. 3 and FIG. 10 to FIG. 12, the air conditioner 100 mainly includes a chassis 11, an outer cover 12, an indoor unit assembly 14, and an outdoor unit assembly 15. An indoor cavity, a mounting channel, and an outdoor cavity are formed between the chassis 11 and the outer cover 12. The middle part of the chassis 11 is recessed towards the inner cavity of the housing to form a mounting groove 1133 for straddling the wall 200.

The indoor unit assembly 14 mainly includes an evaporator 141, a water receiving tray 142 and a impeller 143. The outdoor unit assembly 15 mainly includes a compressor 151, a condenser 152, a motor 153, and a fan 154. Both ends of the evaporator 141 are connected to the compressor 151 and the condenser 152. The condenser 152 is connected to the compressor 151. The motor 153 is connected to the fan 154 to drive the fan 154 to rotate. The fan 154 is adjacent to the condenser 152, the impeller 143 is adjacent to the evaporator 141, and the water receiving tray 142 is provided below the evaporator 141 to receive the condensed water. When the air conditioner 100 is in operation, the indoor air enters the indoor cavity through the air inlet 1311 under the action of the impeller 143. During this process, the air passes through the evaporator 141 and exchanges heat with it, thereby achieving temperature reduction, and then the cooled air is discharged from the air outlet 1312 to the indoor, and thus circulated.

The air conditioner 100 is suitable for being mounted at the lower window frame of the vertical sliding window 21. During installation, the window 21 is removed from the window frame, and then the entire unit of the air conditioner 100 is installed straddling the lower window frame. It is also ensured that the indoor unit assembly 14 of the air conditioner 100 is located indoors on one side of the wall 200, and the outdoor unit assembly 15 of the air conditioner 100 is located outdoors on the other side of the wall 200. Then the air conditioner 100 is slowly placed downward, so that the lower window frame and the corresponding wall 200 are located in the mounting groove 1133 of the housing of the air conditioner 100, until the bottom wall of the mounting groove 1133 of the air conditioner 100 is in contact with the lower window frame. Then the position of the air conditioner 100 is properly adjusted, and the filler in the gap is plugged between the air conditioner 100 and the window, ensuring that the air conditioner 100 can be stably mounted at the window frame to avoid shaking of the air conditioner 100, and finally the vertical sliding window 21 is installed into the window. Since the size of the mounting groove 1133 of the housing of the air conditioner 100 in the height direction of the housing is smaller than the height of the housing, and the bottom wall of the mounting groove 1133 is close to the top cover 122 of the housing, when the air conditioner 100 is mounted at the window frame of the wall 200, it takes up less space and does not affect the activity of the vertical sliding window.

Other configurations and operations of the air conditioner 100 according to the embodiments of the present disclosure are known to those of ordinary skill in the art, and will not be described in detail here.

In the description of the present disclosure, it should be understood that the azimuth or positional relationship indicated by the terms "center," "longitudinal," "transverse," "length," "width," "thickness," "up," "down," "front," "rear," "left," "right," "vertical," "horizontal," "top," "bottom," "inner," "outer," "clockwise," "counterclockwise,"

"axial," "radial," "circumferential," etc., is based on the azimuth or positional relationship shown in the drawings, just to facilitate the description of the present disclosure and simplify the description, and does not indicate or imply that the referred device or element must have a specific orientation, be constructed and operated in a specific orientation, and therefore cannot be construed as limiting the present disclosure.

In the present disclosure, unless otherwise clearly specified and limited, the terms "mount," "connect," "fix" and other terms should be understood in a broad sense. For example, it can be a fixed connection, a detachable connection, or integrally-formed; can be mechanical connection, electrical connection or communication with each other; can be directly connected or indirectly through an intermediary; can be the communication between the two elements or the interaction between the two elements, unless otherwise specifically defined. Those of ordinary skill in the art can understand the specific meanings of the above terms in the present disclosure according to specific situations.

In the description of this specification, the description of the terms "one embodiment," "some embodiments," "examples," "specific examples," or "some examples," etc. means that the specific features, structures, materials, or characteristics described in connection with the embodiment or example are included in at least one embodiment or example of the present disclosure. In this specification, the schematic representation of the above terms does not necessarily refer to the same embodiment or example. Moreover, the specific features, structures, materials, or characteristics described may be combined in any suitable manner in any one or more embodiments or examples. In addition, without contradicting each other, those skilled in the art may combine different embodiments or examples and features of the different embodiments or examples described in this specification. Although the embodiments of the present disclosure have been shown and described above, it can be understood that the above-mentioned embodiments are exemplary and cannot be construed as limiting the present disclosure. Those skilled in the art can make changes, modifications, substitutions, and variations to the above-described embodiments within the scope of the present disclosure.

What is claimed is:

1. An air conditioner comprising:

a housing including an indoor cavity and an outdoor cavity spaced apart from and communicating with each other, a part of a bottom wall of the housing being recessed towards an inner cavity of the housing to form a mounting groove and penetrating opposite side walls of the housing, the mounting groove being located between the indoor cavity and the outdoor cavity;

an indoor unit assembly provided in the indoor cavity; and an outdoor unit assembly connected to the indoor unit assembly and provided in the outdoor cavity;

wherein the housing includes a chassis, the chassis including:

an indoor chassis, the indoor unit assembly being mounted at the indoor chassis;

an outdoor chassis, the outdoor unit assembly being mounted at the outdoor chassis; and a connection plate, two ends of the connection plate being connected to the indoor chassis and the outdoor chassis, respectively, and a section of the connection plate in a longitudinal direction of the housing generally having an "n" shape viewing from a perspective perpendicular to the longitudinal direction of the housing.

2. The air conditioner of claim 1, wherein the chassis further includes:

an outer cover covering the chassis, the indoor cavity and the outdoor cavity being formed between the outer cover and the chassis, the outer cover and a bottom wall of the mounting groove forming a mounting channel communicating with the indoor cavity and the outdoor cavity.

3. The air conditioner of claim 2, wherein the indoor unit assembly and the outdoor unit assembly are connected through a refrigerant pipeline and/or a power line, and at least a part of the refrigerant pipe and/or at least a part of the power line are arranged in the mounting channel.

4. The air conditioner of claim 2, wherein the chassis includes a flange at an outer edge of the chassis and connected to the outer cover.

5. The air conditioner of claim 2, wherein the outer cover includes:

two side plates provided at opposite sides of the chassis, the two side plates being connected to the chassis, each of the two side plates including an avoiding groove for avoiding the mounting groove; and a top cover covering and connected to the two side plates.

6. The air conditioner of claim 1, wherein the chassis is an integral part.

7. The air conditioner of claim 1, wherein the air conditioner is configured to be mounted at a window in a wall, the chassis is configured to straddle a lower frame of the window in the wall, the indoor unit assembly is configured to be located indoors, and the outdoor unit assembly is configured to be located outdoors.

8. The air conditioner of claim 2, wherein the outer cover includes:

two side plates provided at opposite sides of the chassis, the two side plates being connected to the chassis, each of the two side plates including an avoiding groove located at one end of the mounting groove and exposing the mounting groove; and a top cover covering and connected to the two side plates.

9. The air conditioner of claim 1, wherein the indoor unit assembly includes an evaporator, the outdoor unit assembly includes a condenser and a compressor, and the evaporator, the condenser, and the compressor are connected through a refrigerant pipeline.

* * * * *